US012420157B1

(12) United States Patent
Cardoza

(10) Patent No.: US 12,420,157 B1
(45) Date of Patent: Sep. 23, 2025

(54) UFO SAUCER TOSS GAME

(71) Applicant: Ronald J. Cardoza, Colfax, CA (US)

(72) Inventor: Ronald J. Cardoza, Colfax, CA (US)

( * ) Notice: Subject to any disclaimer, the term of this patent is extended or adjusted under 35 U.S.C. 154(b) by 0 days.

(21) Appl. No.: 19/170,221

(22) Filed: Apr. 4, 2025

Related U.S. Application Data

(60) Provisional application No. 63/574,438, filed on Apr. 4, 2024.

(51) Int. Cl.

| | |
|---|---|
| ***A63B 67/06*** | (2006.01) |
| ***A63B 63/08*** | (2006.01) |
| ***A63B 65/10*** | (2006.01) |
| ***A63B 71/00*** | (2006.01) |
| ***A63B 71/02*** | (2006.01) |
| ***A63B 71/06*** | (2006.01) |

(52) U.S. Cl.
CPC ..... *A63B 67/06* (2013.01); *A63B 63/08* (2013.01); *A63B 65/10* (2013.01); *A63B 71/0036* (2013.01); *A63B 71/022* (2013.01); *A63B 71/0622* (2013.01); *A63B 2067/065* (2013.01); *A63B 2071/0633* (2013.01); *A63B 2225/093* (2013.01)

(58) Field of Classification Search
CPC ..... A63B 67/06; A63B 63/08; A63B 65/10; A63B 71/0036; A63B 71/022; A63B 71/0622; A63B 2067/065; A63B 2071/0633; A63B 2225/093
See application file for complete search history.

(56) References Cited

U.S. PATENT DOCUMENTS

2005/0282665 A1* 12/2005 Tarng ..... A63B 59/30 473/588

FOREIGN PATENT DOCUMENTS

GB 2585241 A * 1/2021 ..... A63B 71/06
KR 20140094904 A * 7/2014 ..... A63B 71/0622

* cited by examiner

*Primary Examiner* — Jeffrey S Vanderveen
(74) *Attorney, Agent, or Firm* — Sandy Lipkin

(57) ABSTRACT

A tossing game using a flat planar playing board that is elevated off the ground. The flat planar playing board includes rows of apertures with a certain diameter which correspond to specific scoring points. A backstop with a net is included as well as adjustable legs to elevate the flat planar surface off the ground. Tossing elements shaped like flying saucers are aimed at the apertures for scoring. Adult sized tossing elements have a larger diameter than the apertures on the flat planar surface playing board and a child sized tossing elements have a smaller diameter than the apertures on the flat planar surface playing board. A chime is included in the center aperture which is the highest scoring aperture that goes off when child tossing elements pass therethrough. A specialized carrying bag houses the tossing elements and is ergonomically designed for easy carry around the hip of a carrier.

12 Claims, 6 Drawing Sheets

UFO SAUCER TOSS GAME

BACKGROUND OF THE INVENTION

Reference to Prior Application

This application claims priority of the provisional patent application 63/574,438, filed Apr. 4, 2024 entitled UFO SAUCER TOSS by Ronald J. Cardoza.

FIELD OF THE INVENTION

The field of this invention relates generally to the field of tossing games, and more particularly toward a tossing game where players try and throw saucer-shaped objects into apertures on a surface elevated above the ground and with a backstop.

DESCRIPTION OF THE PRIOR ART

Throwing games are popular for people of all ages. Further, the notion of unidentified flying objects and flying saucers have held fascination for people for many decades, if not longer.

It is the object of the instant invention to provide a throwing game that can be played indoors or outdoors by people of all ages that incorporates unidentified flying objects and flying saucers into the play.

SUMMARY OF THE INVENTION

The basic embodiment of the present invention teaches a tossing game apparatus comprising: a playing board that is a flat, thin planar surface, said playing board having a front edge, a rear edge, a first side edge and a second side edge with a plurality of apertures placed therethrough, said plurality of apertures having a specific diameter; a back stop attached to said rear edge; two or more adjustable legs below said playing board; a plurality of tossing elements, said tossing elements having a diameter either larger or smaller than said specific diameter of said plurality of apertures; and a chime placed on a centermost aperture amongst said plurality of apertures that makes an audible sound when a tossing element with a diameter smaller than said specific diameter of said plurality of apertures passes therethrough.

The above embodiment can be further modified by defining that said plurality of tossing elements are shaped like a flying saucer, each of said plurality of tossing elements further comprising: a center diameter potion; a top portion that extends above said center diameter portion at a taper culminating in a top surface with a diameter less than said center diameter portion; and a bottom portion that extends below said center diameter portion at a taper culminating in a bottom surface with a diameter less than said center diameter portion and matching the diameter of said top surface.

The above embodiment can be further modified by defining that a carrying bag for said plurality of tossing elements, said carrying bag having a top rigid portion with a curved element added, a strap attached to said top rigid portion and an enclosed mesh portion extends down from said top rigid portion creating a space therein to house said tossing elements.

The above embodiment can be further modified by defining that each of said plurality of tossing elements has a numerical value attached to them.

The above embodiment can be further modified by defining that said plurality of apertures are assigned a specific scoring value based on its position on said playing board.

An alternate embodiment of the invention teaches a method of playing a tossing game comprising the steps of: acquiring a tossing game apparatus, said tossing game apparatus further comprising: a playing board that is a flat, thin planar surface, said playing board having a front edge, a rear edge, a first side edge and a second side edge with a plurality of apertures placed therethrough, said plurality of apertures having a specific diameter; a back stop attached to said rear edge; two or more adjustable legs below said playing board; a plurality of tossing elements, said tossing elements having a diameter either larger or smaller than said specific diameter of said plurality of apertures; and a chime placed on a centermost aperture amongst said plurality of apertures that makes an audible sound when a tossing element with a diameter smaller than said specific diameter of said plurality of apertures passes therethrough; positioning a player a specified distance from said playing board; tossing one of said plurality of tossing elements toward said playing board; and providing a score value based on where said one of said plurality of tossing elements lands on said playing board.

The above embodiment can be modified by defining that each of said plurality of tossing elements are shaped like a flying saucer, each of said plurality of tossing elements further comprising: a center diameter potion; a top portion that extends above said center diameter portion at a taper culminating in a top surface with a diameter less than said center diameter portion; and a bottom portion that extends below said center diameter portion at a taper culminating in a bottom surface with a diameter less than said center diameter portion and matching the diameter of said top surface wherein when said center diameter portion either lands on top of one of said plurality of apertures or passes therethrough, a score value is tallied.

The above embodiment can be further modified by defining that each of said plurality of tossing elements are assigned a numerical value and wherein an order of play is determined by said numerical value as a player randomly selects one of each of said plurality of tossing elements prior to starting play.

The above embodiment can be further modified by defining that said each of plurality of apertures are assigned a scoring value based on a position of each of said plurality of apertures on said playing board.

The above embodiment can be further modified by defining that a winner is determined by which player reaches a designated score first.

The above embodiment can be further modified by defining that a winner is determined when said chime provides an audible sound.

The above embodiment can be further modified by defining that a position of playing board relative to the ground is adjusted by said two or more adjustable legs.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
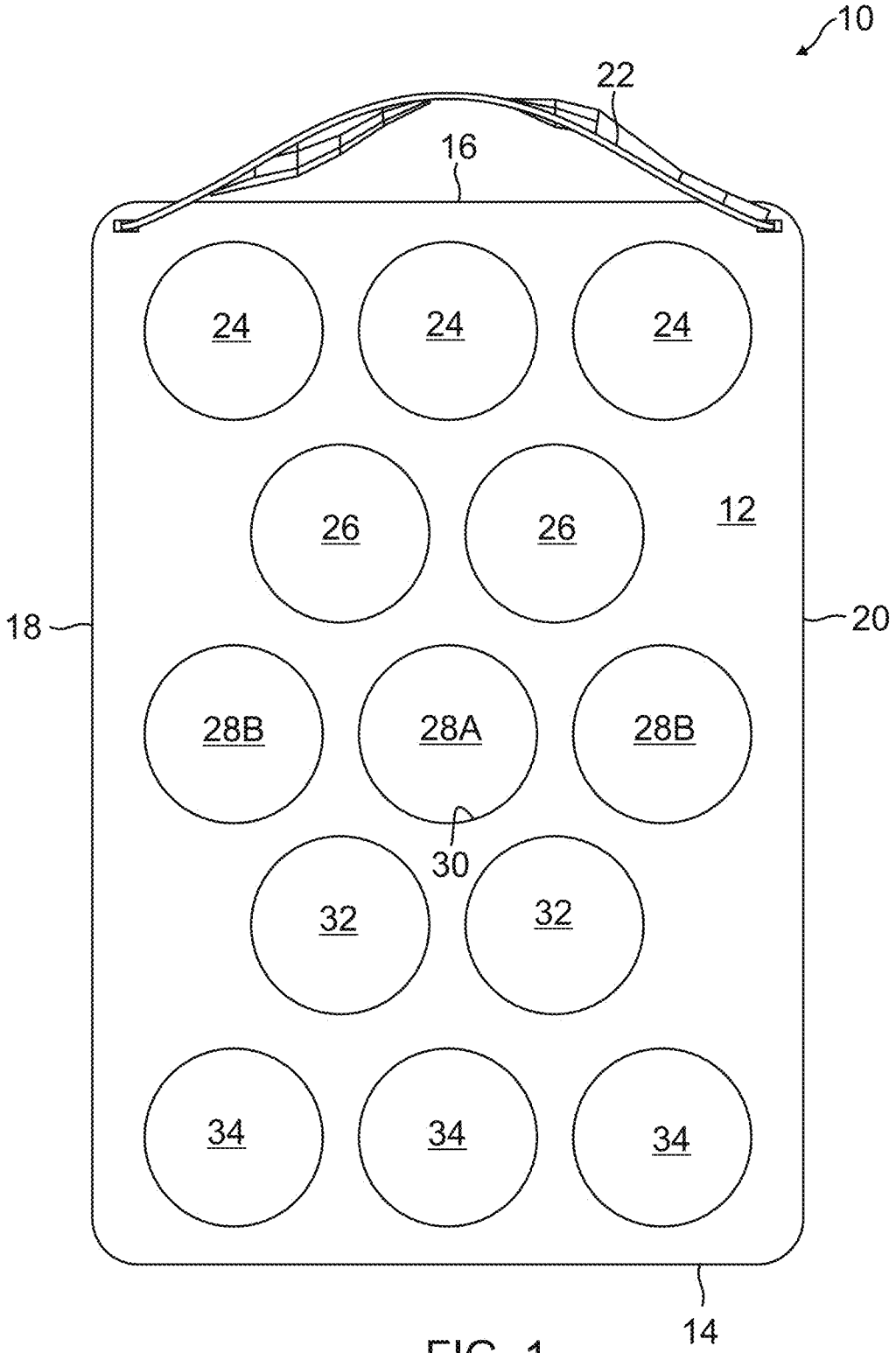
FIG. 1 is a top view of the playing board of the UFO saucer toss game of the instant invention.

Turning to the drawings, the preferred embodiment is illustrated and described by reference characters that denote similar elements throughout the several views of the instant invention.

The preferred embodiment of the instant invention provides for a tossing game that can be played by people of all ages both indoors and outdoors. The game involves a playing board with a flat planar surface with apertures carved out of the flat planar surface of a specific diameter into which tossing elements are aimed to throw into. The flat planar surface sits on top of legs that elevate the board off of the floor. A back stop is included at the rear side of the flat planar surface.

Tossing elements are shaped like flying saucer unidentified flying objects and come in two different sizes, one for adult players and one for child players. The tossing element for children is smaller than the tossing element for adults. The rules of the game, outlined below, are also modified for adult play or child play. A specialized bag is included in the game elements that can accommodate the different sized tossing elements. The bag is completely collapsible made with a see-through mesh. It has a rigid upper frame with a strap attached thereto for carrying around the shoulder of a player. A curve is placed into the rigid upper frame to rest comfortably against the hip of the person carrying the bag.

The rules of the game are as follows for adult players. Each player must be six feet away from the playing board. The adult sized saucers are 7 inches in diameter. The tossing elements have a center periphery that is measured by the 7 inch diameter, but also has a tapered top portion and tapered bottom portion that extend above and below the center periphery to create sections with smaller diameter. There are 7 total saucers and each one is numbered 1 through 7. The holes in the playing board are 6 inches in diameter. As the player tosses the tossing element with the 7 inch center periphery diameter, if it successfully lands one of the 6 inch holes on the playing board, the bottom portion will nestle into the aperture.

At the start of the game, all of the tossing elements are placed in the apertures in the playing board flat planar surface. Each player randomly picks a tossing element from the flat planar surface of the playing board. Each player then look at the number on the tossing element which determines the order of play, e.g., the person with tossing element number one goes, first, the person with tossing element goes second, and so on.

Starting with the first player, each player then collects up all seven tossing elements. Each aperture on the flat planar surface playing board is given a value, with the center aperture having the highest value, with the values decreasing as the apertures are situated further away from center. Points are awarded with each successful landing of the tossing element in an aperture. The first player to reach 700 points wins the game. Each player tosses all 7 tossing elements, tallies their points until all 7 have been tossed, after which the next designated player takes their turn. In the case of a tie, there is a playoff for fresh points.

The rules change slightly for children. The tossing element for children is smaller in diameter than the adult tossing element at 5 inches and is also smaller than the apertures in the flat planar surface of playing board at 5 inches. For a child to score, the tossing element falls through the aperture into the floor. The child player stands 5 feet away from the playing board rather than 6 feet. There are 5 total tossing elements rather than 7 but the same process for determining player order is employed when children play, i.e., each player randomly chooses a tossing element and the order of play corresponds to the number on the tossing element randomly chosen. The children have tossing elements to throw. Winning is determined differently for children. Either the first to 500 points wins using the outer apertures. However, if a child player sinks the tossing element in the center hole, once it falls to the ground, a chime goes off and the child wins the game.

The structure of the game pieces are not limited to the dimensions cited, but are simply use as examples. The important thing is that the diameter of the tossing element for adults excess the diameter of the apertures in the flat planar surface of the playing board and that the diameter of the child tossing element is smaller than the diameter of the apertures in the flat planar surface of the playing board. Similarly, the dimensions of the playing board itself are not limited, but are described here as examples. In the defined embodiment, the flat planar surface of the playing board is 2'×3' and the apertures are 6 inches in diameter. There are five rows of apertures. The back of the board has a net backstop extending upward from the back of the flat planar surface of the playing board. The back row of apertures total 3 and have a scoring value of 25 points. The second from back row has two apertures total with a scoring value of 50. The center row has three total apertures, the center one having a scoring a value of 100 but the two the side only have a value of 25. Another row in front of the center row has two apertures with a value of 50 and the front row has three apertures with a scoring value of 25. The center 100 point hole will have a chiming mechanism when a smaller tossing element passes therethrough for the sake of the children's rules version of the game.

Adjustable legs are placed at the for corners of the flat planar playing surface to elevate the playing board of the ground at a variety of heights. The tossing elements are made of a strong, lightweight material that makes the accurate throwing more challenging due to the lightweight. A storage bag stores the tossing elements, the storage bag having a rigid upper frame with a built in curve to conform the hip of the person carrying it. A strap is attached to the upper rigid frame and a fine mesh is attached to the bottom creating the enclosure to carry the tossing elements.

FIG. 1 shows a top view of the flat planar surface 12 of the playing board 10. The playing board has a front edge 14, a rear edge 16, a first side edge 18, and a second side edge 20. Attached to the rear edge 16 is the backstop 22 made of netting similar to butterfly nets. The flat planar surface 12 includes a first plurality of apertures 24 proximate the rear edge 16 with a lowest value, a second plurality of apertures 26 in front of said first plurality of apertures with a slightly higher value, a center plurality of apertures 28A, 28B with the center aperture 28A having the highest value for adult play and the winning chime 30 for child's play. In front of the center plurality of apertures are a fourth plurality of apertures 32 with a score value that matches the second plurality of apertures and a fifth front plurality of aperture 34 with the lowest score value. The two side center apertures 28B have the same lowest value as the first plurality and fifth front plurality of apertures. All of the apertures 24, 26, 28A, 28B, 32, 34 have a diameter of 6 inches.

Figure 2:
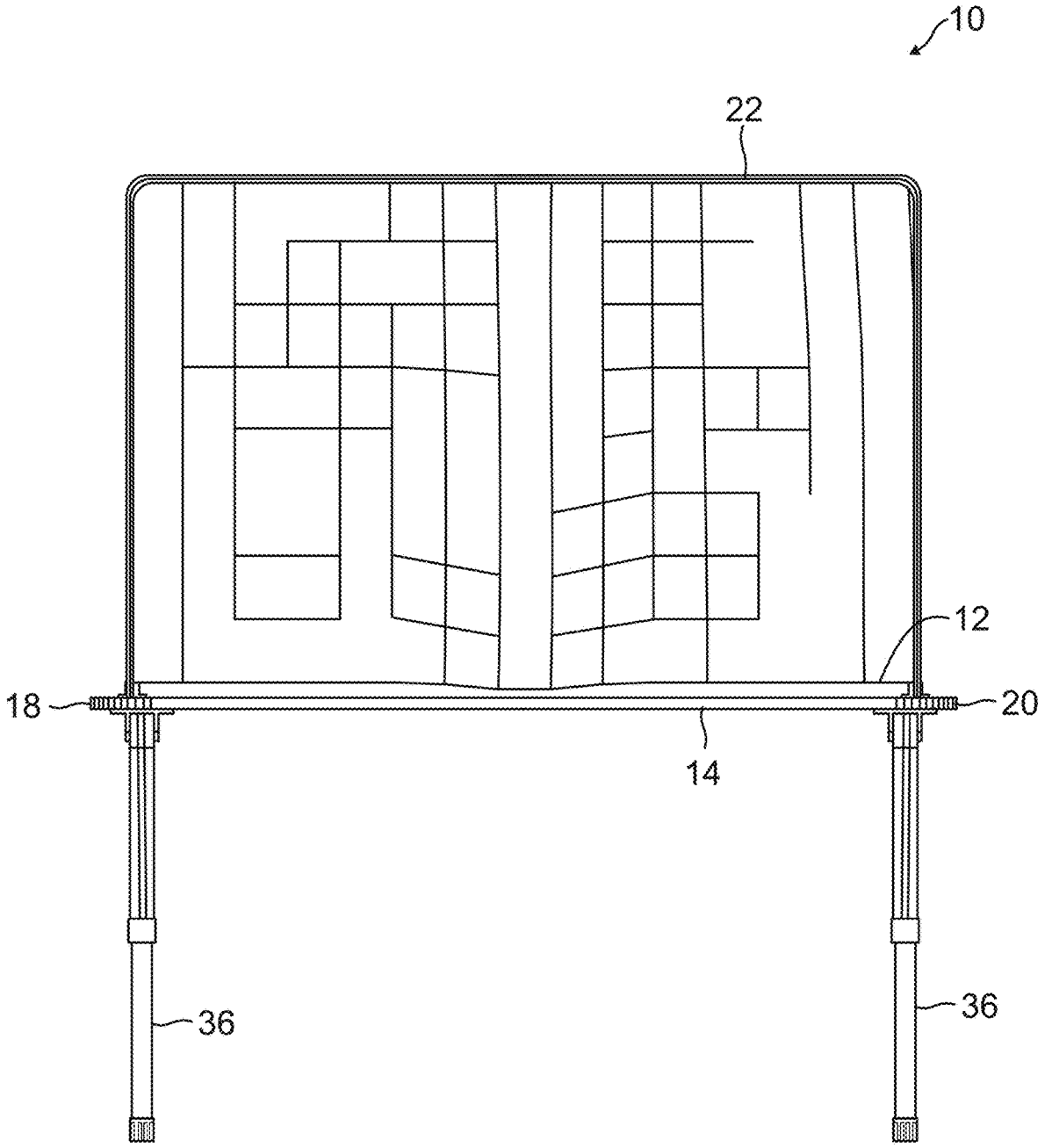
FIG. 2 is front view of the playing board of the UFO saucer toss game of the instant invention.
Figure 3:
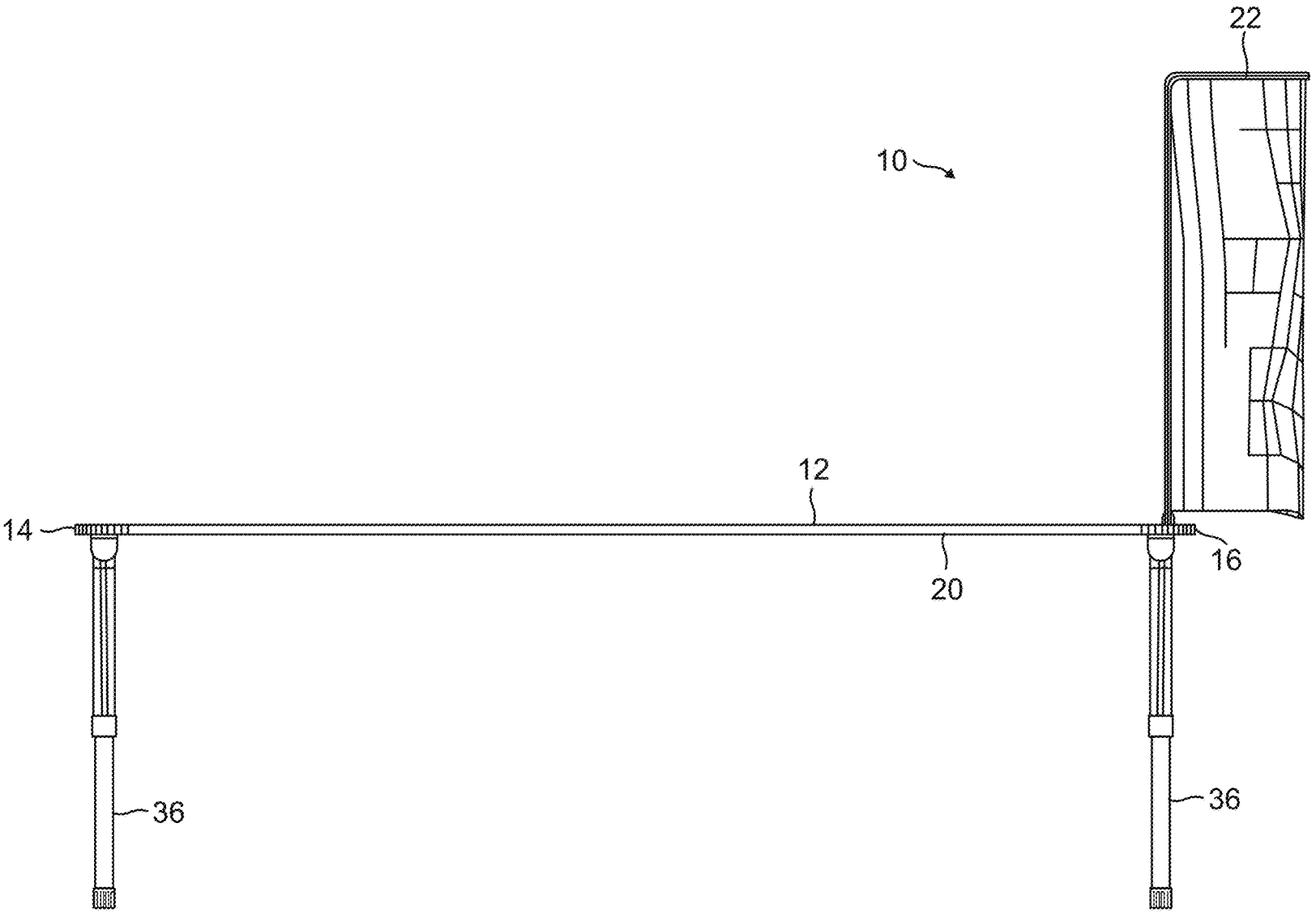
FIG. 3 is a side view of the playing board of the UFO saucer toss game of the instant invention.

FIG. 2 shows the same elements as in FIG. 1, but with the additional ability to see the adjustable height legs 36 situated around the bottom of the flat planar surface 12 of the playing board 10. These elements are similarly visible in FIG. 3.

Figure 4:
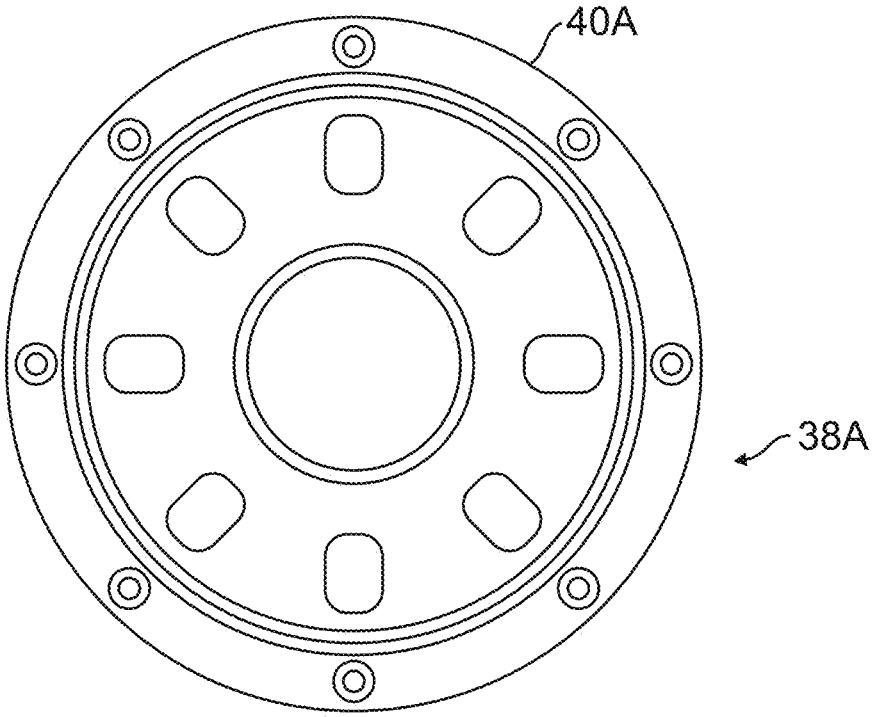
FIG. 4 is a top view of the larger, adult sized tossing element of the UFO saucer toss game of the instant invention.
Figure 5:
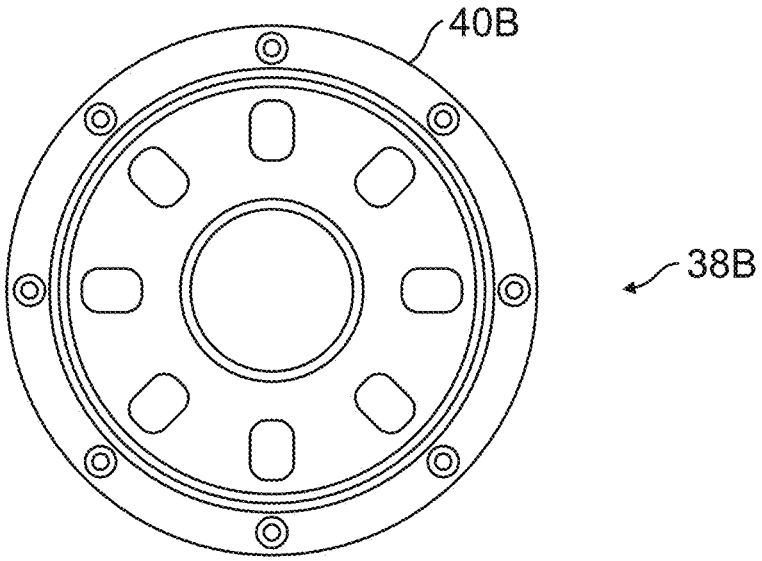
FIG. 5 is a top view of the smaller, child sized tossing element of the UFO saucer toss game of the instant invention.
Figure 6:
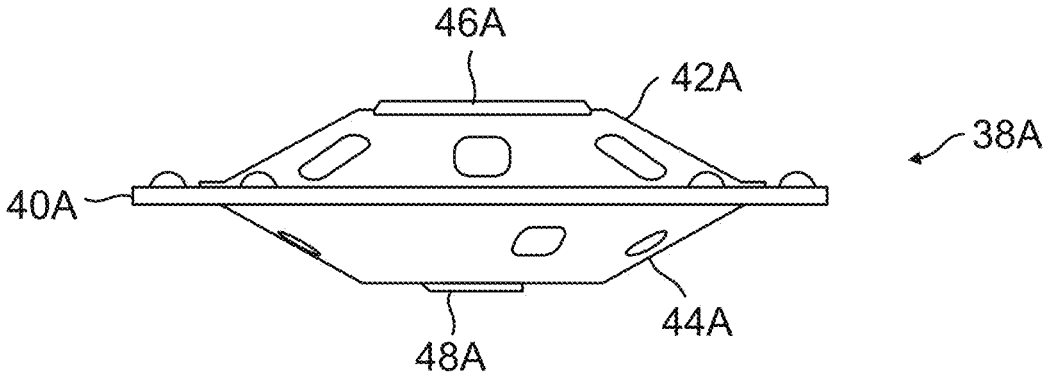
FIG. 6 is a side view of the larger, adult sized tossing element of the UFO saucer toss game of the instant invention.
Figure 7:
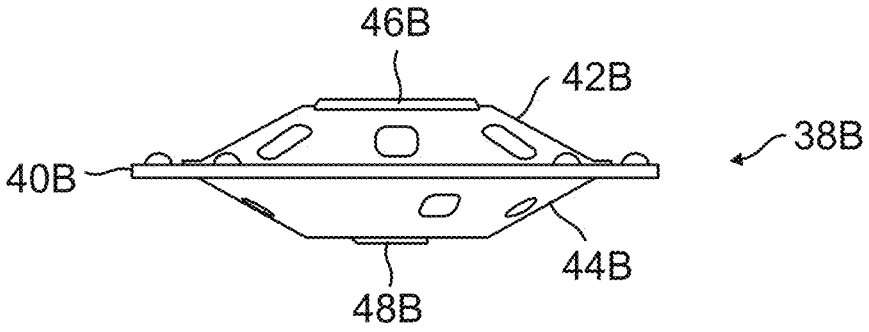
FIG. 7 is a side view of the smaller, child sized tossing element of the UFO saucer toss game of the instant invention.

FIGS. 4-7 show various views of the two different sizes of tossing elements. FIG. 4 is a top view of the adult sized tossing element 38A whereas FIG. 5 shows a top view of the child sized tossing element 38B. Similarly, FIG. 6 shows a side view of the adult sized tossing element 38A and FIG. 7 shows a side of the child sized tossing element 38B. Both tossing elements 38A, 38B are designed to look like a flying saucer, the adult tossing element 38A having a center diameter portion 40A of 7 inches and the child's tossing element having a center diameter portion 40B of 5 inches. As clearly shown in FIGS. 6 and 7, both tossing elements 38A, 38B have a top portion 42A, 42B and a bottom portion 44A, 44B. In both cases, the top portions 42A, 42B extend upward from the center diameter portion 40A, 40B at a taper to terminate in a top surface 46A, 46B that is flat and with a smaller diameter. Analogously, bottom portions 44A, 44B extend downward from the center diameter portion 40A, 40B at a taper to terminate in a bottom surface 48A, 48B that is flat and with a smaller diameter that matches the top surfaces 46A, 46B.

Figure 8:
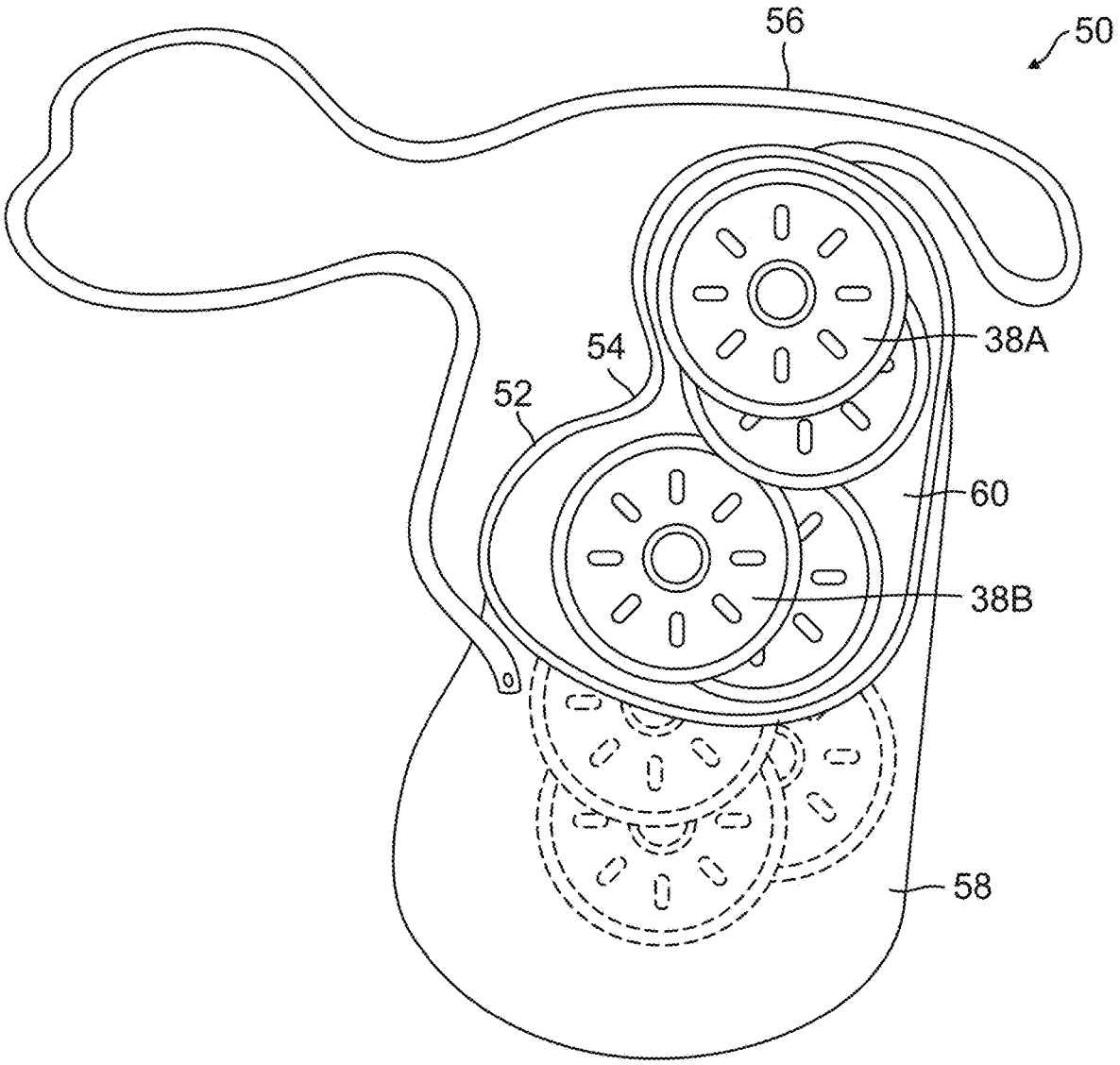
FIG. 8 is front view of the specialized bag that holds the tossing elements of the UFO saucer toss game of the instant invention.

FIG. 8 shows the carrying bag 50 that carries the tossing elements 38A, 38B of the game. The carrying bag includes a top rigid element 52 shaped with a curve 54 to accommodate the hip of the person carrying the bag 50. A strap 56 is attached to the top rigid portion 52 and an enclosed mesh bag 58 extends downward from the top rigid portion 52 creating an interior space 60 into which the tossing elements 38A, 38B are placed for safekeeping and carrying.

The invention illustratively disclosed herein suitably may be practiced in the absence of any element which is not specifically disclosed herein.

The discussion included in this detailed description is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A tossing game apparatus comprising:

a playing board that is a flat, thin planar surface, said playing board having a front edge, a rear edge, a first side edge and a second side edge with a plurality of apertures placed therethrough, said plurality of apertures having a specific diameter;

a back stop attached to said rear edge;

two or more adjustable legs below said playing board;

a plurality of tossing elements, said tossing elements having a diameter either larger or smaller than said specific diameter of said plurality of apertures; and a chime placed on a centermost aperture amongst said plurality of apertures that makes an audible sound when a tossing element with a diameter smaller than said specific diameter of said plurality of apertures passes therethrough.

2. The tossing game apparatus as defined in claim 1 wherein said plurality of tossing elements are shaped like a flying saucer, each of said plurality of tossing elements further comprising:

a center diameter potion;

a top portion that extends above said center diameter portion at a taper culminating in a top surface with a diameter less than said center diameter portion; and a bottom portion that extends below said center diameter portion at a taper culminating in a bottom surface with a diameter less than said center diameter portion and matching the diameter of said top surface.

3. The tossing game apparatus as defined in claim 1 further comprising a carrying bag for said plurality of tossing elements, said carrying bag having a top rigid portion with a curved element added, a strap attached to said top rigid portion and an enclosed mesh portion extends down from said top rigid portion creating a space therein to house said tossing elements.

4. The tossing game apparatus as defined in claim 1 wherein each of said plurality of tossing elements has a numerical value attached to them.

5. The tossing game apparatus as defined in claim 1 wherein said plurality of apertures are assigned a specific scoring value based on its position on said playing board.

6. A method of playing a tossing game comprising the steps of:

acquiring a tossing game apparatus, said tossing game apparatus further comprising:

a playing board that is a flat, thin planar surface, said playing board having a front edge, a rear edge, a first side edge and a second side edge with a plurality of apertures placed therethrough, said plurality of apertures having a specific diameter;

a back stop attached to said rear edge;

two or more adjustable legs below said playing board;

a plurality of tossing elements, said tossing elements having a diameter either larger or smaller than said specific diameter of said plurality of apertures; and a chime placed on a centermost aperture amongst said plurality of apertures that makes an audible sound when a tossing element with a diameter smaller than said specific diameter of said plurality of apertures passes therethrough;

positioning a player a specified distance from said playing board;

tossing one of said plurality of tossing elements toward said playing board; and providing a score value based on where said one of said plurality of tossing elements lands on said playing board.

7. The method as defined in claim 6 wherein each of said plurality of tossing elements are shaped like a flying saucer, each of said plurality of tossing elements further comprising:

a center diameter potion;

a top portion that extends above said center diameter portion at a taper culminating in a top surface with a diameter less than said center diameter portion; and a bottom portion that extends below said center diameter portion at a taper culminating in a bottom surface with a diameter less than said center diameter portion and matching the diameter of said top surface wherein when said center diameter portion either lands on top of one of said plurality of apertures or passes therethrough, a score value is tallied.

8. The method as defined in claim 6 wherein each of said plurality of tossing elements are assigned a numerical value and wherein an order of play is determined by said numerical value as a player randomly selects one of each of said plurality of tossing elements prior to starting play.

9. The method as defined in claim 6 wherein said each of plurality of apertures are assigned a scoring value based on a position of each of said plurality of apertures on said playing board.

10. The method as defined in claim 6 wherein a winner is determined by which player reaches a designated score first.

11. The method as defined in claim 6 wherein a winner is determined when said chime provides an audible sound.

12. The method as defined in claim 6 wherein a position of playing board relative to the ground is adjusted by said two or more adjustable legs.

* * * * *